US005371986A

United States Patent [19]

Guditis

[11] Patent Number: 5,371,986

[45] Date of Patent: Dec. 13, 1994

[54] POLE REPAIR AND REINFORCING SYSTEM AND METHOD FOR INSTALLING THE SAME

[76] Inventor: Robert J. Guditis, R4 Box 245A, Mondovi, Wis. 54755

[21] Appl. No.: 959,391

[22] Filed: Oct. 13, 1992

[51] Int. Cl.[5] ..... E04G 23/04

[52] U.S. Cl. ..... 52/170; 52/728; 52/514

[58] Field of Search ..... 52/728, 727, 514, 170

[56] References Cited

U.S. PATENT DOCUMENTS 3,350,822 11/1967 Nachazel ..... 52/728
4,327,534 5/1982 Mastalski et al. ..... 52/170
4,644,715 2/1987 Burell et al. ..... 52/514
4,697,396 10/1987 Knight ..... 52/728
4,987,718 1/1991 Knight ..... 52/170

*Primary Examiner*—Carl D. Friedman
*Assistant Examiner*—Christopher Kent

[57] ABSTRACT

A repair system and method for wooden power poles which includes a rigid reinforcing post member having a longitudinal bend formed therein and attachable to the outside surface of a pole to be repaired in overlying relation to the weakened rotted portion thereof, and means for attaching a driving mechanism to the upper portion of the reinforcing post member, and including means for attaching adjacent partially overlapped post members to the upper exposed portion of the pole to be repaired.

2 Claims, 1 Drawing Sheet 10
10a
10b
10c
12
12a
12b
13
13a
14
14a
16
16a
16b
16c
16d
17
18
20
p

POLE REPAIR AND REINFORCING SYSTEM AND METHOD FOR INSTALLING THE SAME

BACKGROUND OF THE INVENTION

In the past, various repair systems have been developed for the repair of rotted sections of wooden poles such as are used for electric transmission lines. For the most part; these have included the use of reinforced concrete or plastic encased around the rotted portion of the pole adjacent to the ground line. Such repair systems are objectionable since they all involve on-site mixing of the semiliquid repair material which is frequently very inconvenient and also requires excavating a large annular hole around the pole to permit installation of the reinforcing encasing material around the pole. Such systems are disclosed in U.S. Pat. Nos. 961,837, issued Jun. 21, 1910 to Briffod; 966,337, issued Aug. 2, 1910 to Lamb; 1,598,591, issued Aug. 31, 1926 to Barrett; 4,365,451, issued Dec. 28, 1982.

In addition to the use of such concrete or plastic reinforced sleeve constructions, a number of inventors have provided outer reinforcing pole stub elements which are driven into the ground with the upper portions thereof overlapping and attached to the above-ground portions of the pole to be reinforced. While these do not require the preparation and insertion of the semi-liquid encasing material on site, they all require the use of relatively complicated attachment mechanisms which involve either drilling holes through the diameter of the pole and the use of bolt and nut attachment means or, in the alternative, require banding of the reinforcing system to the outside of the exposed portion of the pole immediately above the groundline. None of these systems provide the simplistic, easily installed solution provided by the present invention.

SUMMARY OF THE INVENTION

The present invention includes the use of one or more rigid reinforcing bars or elongated reinforcing stub-post members made from generally flat elongated rigid plate material having a longitudinal bend along the center line thereof to provide the required stiffness and facilitate surface-to-surface attachment to the pole and to each other and simultaneous attachment to the surface of the pole to be repaired. The longitudinal bend provides flat attachment wing portions on both sides thereof, the bend angle being a value that associates with a circumscribed polygon (such as 120 degrees for a six-sided polygon) to permit the lateral wing portions to lay flat against each other and lay tangent to the pole surface wherein and pole diameters that occur on the job may be properly fitted. The bars are securely anchored to the pole by lag screws which penetrate radially into the pole through the wing portions and are drilled on the job to simultaneously join adjacent bars into a circumferential reinforcing unit. The strength of each unit thus formed becomes significantly greater than the sum of the separate members due to their attachment together to amplify the composite strength of the joined-together members by producing a greater section modulus.

DETAILED DESCRIPTION OF THE DRAWINGS

Figures 1, 2, 3A, 3B, 3C, 3D, 4, 5, 6, 7, 8, 9:
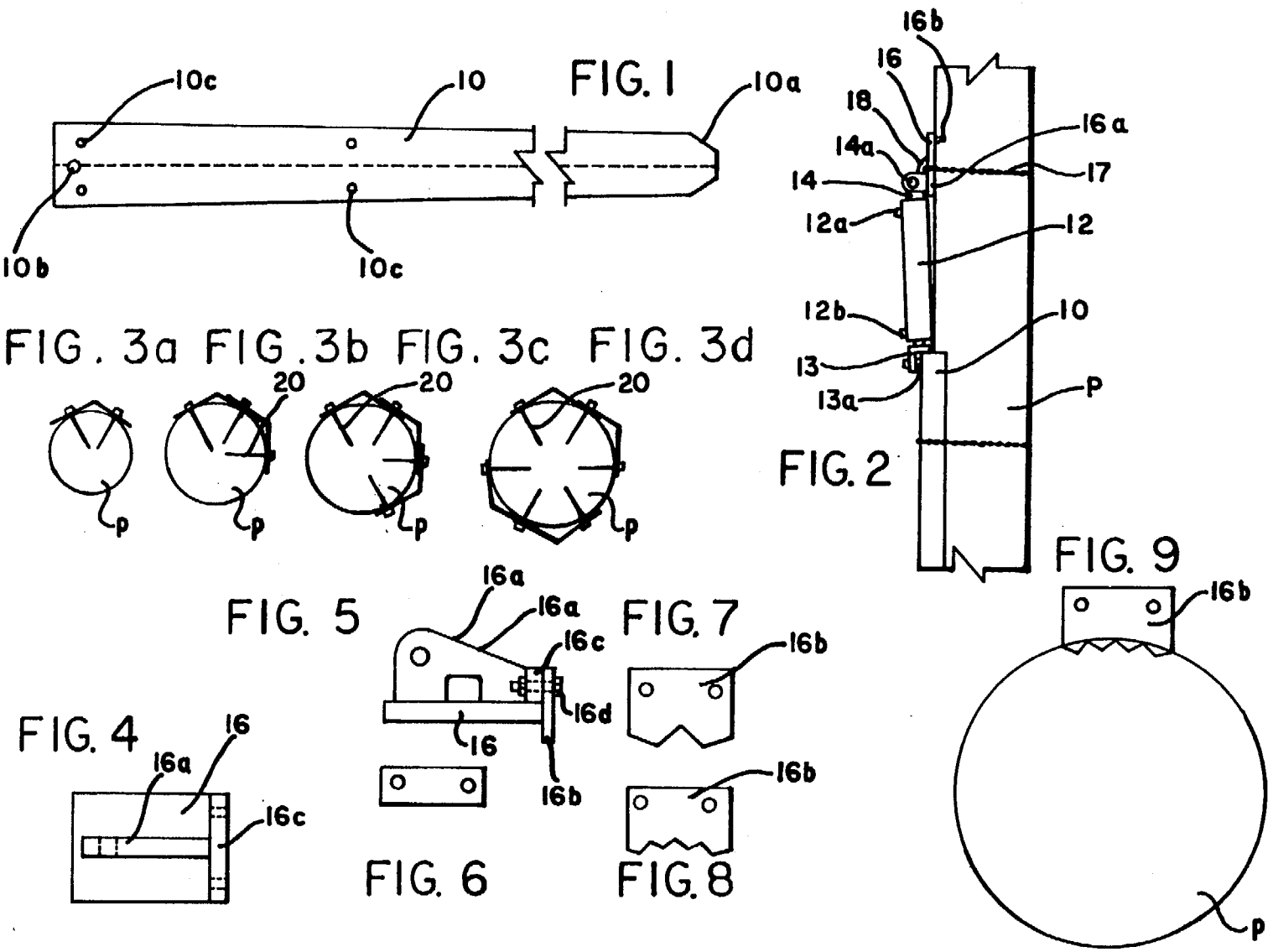
FIG. 1 is a side elevational view of a typical reinforcing post member.
FIG. 2 is a side elevational view of a post member being driven into reinforcing position around a pole to be repaired.

FIGS. 3*a*, 3*b*, 3*c* and 3*d* are horizontal sectional views taken through a pole to be repaired with varying numbers of reinforcing post members secured thereto;

FIG. 4 is a front elevational view of a mounting bracket. per se;

FIG. 5 is a side elevational view thereof with a toothed anchoring bracket attached thereto;

FIG. 6 is an end elevational view of the mounting bracket per se;

FIG. 7 is an elevational view of one form of toothed bracket;

FIG. 8 is a similar view of an alternative form of bracket; and,

FIG. 9 is a top view of the anchoring bracket shown in FIG. 8 in operative position on a pole to be repaired.

DETAILED DESCRIPTION OF THE PREFERRED EMBODIMENT

Each member is constructed of a flat, elongated piece of rigid material, such as ¼" galvanized steel plate stock, bent along the longitudinal center line thereof to form a reinforcing post element 10.

The flat plate stock rigid material from which the reinforcing post members 10 are constructed may be also a rigid plastic material. Each post member 10 is beveled at the bottom, as shown at 10*a*, to facilitate driving the post into the ground adjacent and alongside the outer surface of the power pole to be reinforced. The upper end portion of each post member 10 is provided with an attachment hole 10*b* for connection with a driving member such as hydraulic cylinder 12, which has a clevis 13 and attachment pin 13*a* at the bottom thereof, and a clevis 14 and anchoring pin 14*a* are provided at the top thereof. An mounting bracket 16, is provided for anchoring of the top of the cylinder to the power pole P to be reinforced. Suitable means for anchoring the bracket 16 to the pole are provided, such as the circumferential attachment chain 17 or nylon belt (not shown) which passes around the pole and the outside of the bracket 16 and which is attached by a loop element 18 fixed to the outside. Bracket 16 includes a tongue element 16*a* to which the clevis 14 and pin 14*a* are connected. A toothed anchoring bracket 16*b* is provided for biting into the wooden pole P is illustrated. The bracket 16 has an anchoring flange 16*c* to facilitate attachment of the toothed bracket 16*b* as by the bolts 16*d*. The offset of the attachment pin 14*a* fulcrums the teeth of bracket 16*b* into penetrating the wood of pole to anchor the upper end of the driving cylinder 12.

The hydraulic cylinder 12 has a pair of hydraulic conduit-connecting nipples 12*a* and 12*b* for attachment to a hydraulic pump system (not shown) for actuating the piston within the cylinder and driving the reinforcing post 10 downwardly into the ground alongside the pole P to be repaired. After the post member 10 has been driven into the ground adjacent to the lower surface portion of the pole P, additional posts 10 may also be driven in overlapping relationship to the adjacent reinforcing posts around the pole, as shown in FIG. 3. When sufficient reinforcing post members 10 are in place in the prescribed overlapped relationship, as shown in FIG. 3, holes 10*c* are drilled through the overlapped portions of the posts to permit attachment lag screws 20 to be screwed through the reinforcing post elements into the pole. The lag screws 20 form common attachment means between adjacent overlapping post elements, as well as securely anchoring the post elements 10 to the pole to be repaired.

What is claimed is:

1. A repair system for power poles comprising a power pole to be repaired, a plurality of elongated reinforcing post members, made from generally flat rigid material, and each post member having a longitudinal bend therein forming a bend line with a pair of flat wing portions on each side thereof, means for attaching the wing portions to the pole at a plurality of locations above the ground level of the pole to extend across and bridge a pole section to be repaired, a plurality of post members driven into the ground alongside the pole to be repaired, and having adjacent wing portions disposed in overlapping relation and adjacent to the underlying surface of the pole, and the attachment means anchoring selected overlapped wing portions directly to the pole surface.

2. A method of reinforcing a wooden power pole having a weakened rotted portion adjacent the ground level thereof, providing an elongated reinforcing post member, made from generally flat rigid material, and said reinforcing post member having a longitudinal bend therein forming a bend line with a pair of flat wing portions on each side thereof, driving the post member into the ground adjacent to the outer surface of the pole to be reinforced while portions of the reinforcing post member are positioned against the outer surface of the pole, overlapping similar reinforcing post members and connecting the overlapped flat wing portions directly to the outer surface of the pole to be repaired with common connecting elements, and drilling holes through the overlapped post members after the same have been driven into the ground to permit the connecting elements to be attached to the pole in overlapped relation.

* * * * *